US005437383A

United States Patent [19]

Stull

[11] Patent Number: 5,437,383

[45] Date of Patent: Aug. 1, 1995

[54] SNAP-HINGE CLOSURE CAP WITH FULL CIRCUMFERENTIAL SEAL

[76] Inventor: Gene Stull, 1 Winston Farm La., Far Hills, N.J. 07931

[21] Appl. No.: 74,499

[22] Filed: Jun. 11, 1993

[51] Int. Cl.[6] ..... B65D 47/08

[52] U.S. Cl. ..... 215/235; 220/335; 220/339

[58] Field of Search ..... 215/235; 220/335, 339, 220/4.23; 222/498, 517, 556

[56] References Cited

U.S. PATENT DOCUMENTS

| | | | |
|---|---|---|---|
| 3,289,877 | 12/1966 | Wolf . | |
| 3,741,447 | 6/1973 | Miles et al. . | |
| 3,752,371 | 8/1973 | Susuki et al. . | |
| 3,933,271 | 1/1976 | McGhie . | |
| 4,010,875 | 3/1977 | Babiol . | |
| 4,158,902 | 6/1979 | Chernack et al. . | |
| 4,220,248 | 9/1980 | Wilson et al. . | |
| 4,261,486 | 4/1981 | Bush et al. . | |
| 4,291,818 | 9/1981 | Nozawa et al. . | |
| 4,346,810 | 8/1982 | Kneissl . | |
| 4,386,714 | 6/1983 | Roberto et al. . | |
| 4,403,712 | 9/1983 | Wiesinger . | |
| 4,457,458 | 7/1984 | Heinol . | |
| 4,487,324 | 12/1984 | Ostrowsky . | |
| 4,513,888 | 4/1985 | Curry . | |
| 4,545,495 | 10/1985 | Kinsley . | |
| 4,573,600 | 3/1986 | Bubach | 215/237 |
| 4,793,502 | 12/1988 | Beck | 215/235 |
| 4,848,612 | 7/1989 | Beck | 215/235 |
| 5,257,708 | 11/1993 | Dubach | 220/335 |
| 5,322,176 | 6/1994 | Dubach | 215/235 |
| 5,356,017 | 10/1994 | Rohr et al. | 220/335 |
| 5,358,151 | 10/1994 | Strasenburgh | 220/335 X |
| 5,361,920 | 11/1994 | Nozawa | 215/235 X |
| 5,368,176 | 11/1994 | Thanisch | 215/235 |

FOREIGN PATENT DOCUMENTS

| | | |
|---|---|---|
| 0208413 | 1/1987 | European Pat. Off. . |
| 0328809 | 8/1989 | European Pat. Off. . |
| 0494306 | 7/1992 | European Pat. Off. . |

*Primary Examiner*—Allan N. Shoap
*Assistant Examiner*—Stephen Cronin
*Attorney, Agent, or Firm*—H. Gibner Lehmann; K. Gibner Lehmann

[57] ABSTRACT

A closure cap construction for a container including a cap body adapted to be mounted on the container and having a discharge orifice, and a sealing cap for selectively closing off the discharge orifice thereof. A snap-action or toggle-type dead-center hinge connects the sealing cap to the cap body for movement between an opening and closing position. The cap body and sealing cap have cooperable engageable sealing surfaces providing a complete peripheral seal therebetween when the sealing cap is disposed in its closing position on the cap body. The arrangement is such that the snap-action hinge is disposed completely exteriorly of the sealing surfaces so as to not impair the integrity of the seal provided thereby.

5 Claims, 1 Drawing Sheet

SNAP-HINGE CLOSURE CAP WITH FULL CIRCUMFERENTIAL SEAL

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

FIELD OF THE INVENTION

This invention relates generally to closure caps for containers.

DESCRIPTION OF THE RELATED ART INCLUDING INFORMATION DISCLOSED UNDER 37 CFR 1.97-1.99

| U.S. Pat. Nos.: | | |
|---|---|---|
| 3,289,877 | 3,741,447 | 3,752,371 |
| 3,933,271 | 4,010,875 | 4,158,902 |
| 4,220,248 | 4,261,486 | 4,291,818 |
| 4,346,810 | 4,386,714 | 4,403,712 |
| 4,457,458 | 4,487,324 | 4,513,888 |
| 4,545,495 | | |

U.S. Pat. No. 3,289,877 issued in 1966 discloses the general concept of a snap-action hinge for a box-like container, particularly FIGS. 13–15. Col. 6, beginning on line 22, sets forth an integrally-formed hinge for a ring box that is injection molded.

U.S. Pat. Nos. 3,741,447; 4,545,495; and 3,933,271 illustrate different types of closure cap constructions all employing spring-type hinge mechanisms which provide a dead-center or toggle effect to a hinged cap, biasing it toward either an open position or a closed position. In '495, an annular peripheral shoulder is provided on a base cap, to receive the skirt of the cap, in the position of FIG. 1.

Variations on the basic closure cap toggle mechanism are disclosed in U.S. Pat. Nos. 4,158,902; 4,346,810; 4,386,714; 4,403,712; and 4,487,324.

Still other prior constructions are described in U.S. Pat. Nos. 3,752,371; 4,010,875; 4,220,248; 4,261,486; 4,291,818; 4,457,458; and 4,513,888. These latter seven references disclose different types of spring mechanisms, typically employing abutting resilient spring-like projections in order to provide the desired biasing characteristics to the particular closure.

While a number of different cap constructions have been cited above, there has been a notable lack of commercialization of most of those referred to.

It is believed that the nature of the various spring mechanisms was often a troublesome aspect in attaining a long-lasting, workable design. Excessive stretching of a molded spring component beyond its elastic limits, coupled with the strong tendency for many plastics to take a "set" after a prolonged period of operation in a given position, are believed to be factors contributing to the apparent absence in the marketplace of many of these caps.

In applications involving dispensing of food product, prior caps which did not have peripheral seals were prone to trap water during the processing of the containers after they were filled. In particular, frequently such containers were run through a hot water bath in order to clean them of any residual food which may have splashed onto the exterior during filling. Where hot water became trapped between the base cap and overcap, there occurred problems of seepage and running, at a later time. Under some circumstances, this water seepage subsequently contacted labels that had been applied to the containers. In still other cases, the trapped water contained a certain amount of mineral deposits which became deposited on the exterior of the container, leaving unsightly grey colored stains which were sometimes mistaken for mold or mildew. The stains rendered the containers unuseable for food products.

The problem of maintaining the area between the base cap and overcap clear of rinse water has not been particularly addressed in the art cited, and thus it is considered that the prior art caps do not inherently possess the necessary characteristics to avoid or otherwise solve this problem of trapped water.

SUMMARY OF THE INVENTION

The above disadvantages and drawbacks of prior snap-action closure cap constructions are obviated by the present invention which has for one object the provision of a novel and improved closure cap construction of the type having a snap-action or toggle-type hinge, and which exhibits superior sealing and water-barrier characteristics.

A related object of the invention is to provide an improved closure cap construction in accordance with the foregoing, which is extremely easy to open and close, thereby rendering it convenient for the consumer to use.

Still another object of the invention is to provide an improved closure cap as outlined above, wherein the cap body and sealing cap, together with an integral toggle hinge, can be especially economically molded as a single integral component, in relatively simple mold cavities.

Yet another object of the invention is to provide an improved closure cap construction as above characterized, which can be readily applied to containers, with automatic capping equipment.

A still further object of the invention is to provide an improved closure cap construction as above set forth, including toggle-type hinge structures of relatively small and unobtrusive configuration, so as to minimize the possibility of damage thereto during filling of the associated containers, and during handling and/or processing, and subsequent shipment. The construction makes it feasible to employ automatic capping equipment in the application of the caps to the containers.

A related object of the invention is to provide an improved closure cap construction of the kind indicated, which is aesthetically pleasing to the consumer, thereby making it attractive and eye-catching in its appearance, while maintaining complete functional integrity.

The above objects are accomplished by a closure cap construction for a container, comprising in combination a cap body adapted to be mounted on the container, the cap body having a discharge orifice, a sealing cap for the cap body, and snap-action hinge means connecting the sealing cap to the cap body for movement between an opening and a closing position thereon. The cap body and sealing cap have cooperable engageable sealing means providing a complete peripheral seal therebetween when the sealing cap is disposed in its closing position on the cap body. The snap-action hinge means is disposed completely exteriorly of the sealing means so as to not impair the integrity of the latter.

The objects are further accomplished by a one-piece molded plastic cap construction for a container, comprising in combination a cap body adapted to be mounted on the container, the cap body having a discharge orifice, a sealing cap for the cap body, and snap-action hinge means integral with the cap body and sealing cap, connecting the sealing cap to the cap body for movement between an opening and a closing position thereon. The cap body and sealing cap have integral cooperable engageable sealing means providing a complete peripheral seal therebetween when the sealing cap is disposed in its closing position. The sealing means comprises a peripheral rim on the sealing cap and a peripheral shoulder on the cap body, and the snap-action hinge means is disposed completely exteriorly of the peripheral rim and the cooperable shoulder so as to not impair the integrity of the seal between the rim and shoulder.

The arrangement is such that when the caps are used with food products such as ketchup, for example, after the containers are filled the caps can be applied, and the thus-capped containers subsequently run through a series of high pressure water sprays for cooling and/or cleaning, prior to labeling and packaging. Any tendency for water to accumulate between the sealing cap and cap body is eliminated by the complete peripheral seal; thus there is completely avoided the possibility of trapped water subsequently dripping or seeping onto a label, or perhaps evaporating and leaving an unsightly residue or mineral deposit.

Other features and advantages will hereinafter appear.

DESCRIPTION OF THE PREFERRED EMBODIMENT

Figure 1:
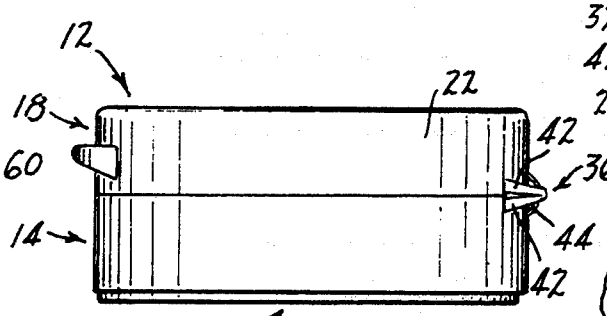
FIG. 1 is a side elevation of the improved hinged closure cap construction of the present invention.
Figure 2:
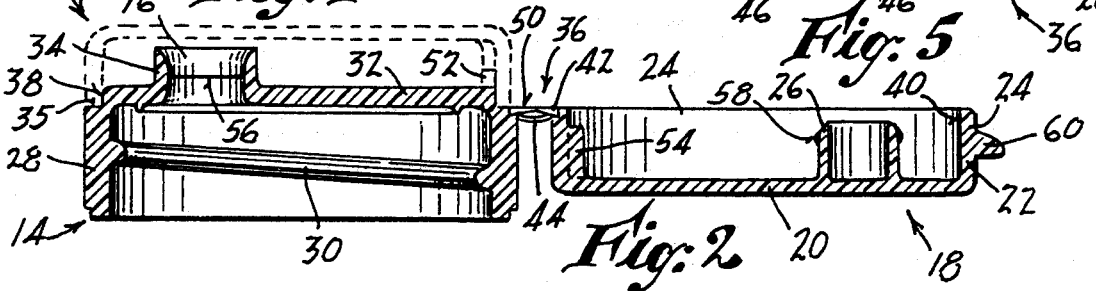
FIG. 2 is an axial section of the cap construction of FIG. 1, with the hinged sealing cap shown in solid outline in the position in which it would be molded. The sealing cap is shown in dotted outline, in its closed, sealing position.

Referring first to FIGS. 1 and 2 there is illustrated a closure cap construction 12 for securement to a container (not shown) of the type having a neck with external threads, and constituted of either plastic or glass.

The closure cap construction comprises a cap body 14 having a discharge orifice or opening 16, and a sealing cap 18 carried on the cap body and adapted to close off the discharge orifice 16 thereof. The sealing cap 18 is moveable on the cap body between a closing position illustrated in FIG. 1 and an opening position shown in FIG. 2. The sealing cap 18 has a transverse top wall 20 and an annular depending wall or skirt 22 terminating in a circular rim or lip 24. A hollow sealing plug 26 extends downward from the transverse top wall 20.

The cap body 14 has the configuration of an inverted cup, with an annular wall or skirt 28, and an internal thread 30 on the wall 28 for engagement by the threads of the container neck (not shown). The upper portion of the cap body has a central raised plateau, dome or wall 32 which contains an upstanding pouring spout 34, constituting the discharge orifice 16. Surrounding the plateau is an upwardly facing annular shelf or shoulder 35.

In accordance with the present invention there is provided a new combination comprising a full peripheral seal between the peripheral surface of the plateau 32 of the cap body 14 and the rim 24 of the sealing cap 18, together with a unique integrally-molded hinge structure 36 which imparts a dead-center toggle function to the sealing cap 18 during its movement between opening and closing positions on the cap body 14.

In accomplishing the peripheral seal as embodied by the invention, the plateau 32 of the cap body 14 preferably is of a circular outline, having a vertical annular peripheral wall surface 38 extending completely through an angle of substantially 360°. The dimension of the wall surface 38 is such that it can snugly nest in and seal against the inner surface 40 of the sealing cap rim when the latter is disposed in its closing position of FIG. 1. The arrangement is such that in the FIG. 1 position, the space between the plateau 32 and the transverse wall 20 of the sealing cap 18 is completely isolated from the exterior of the sealing cap 18 by the peripheral seal, thereby positively preventing entry of water and/or debris into this space during handling and after the sealing cap has been closed. The importance of this full 360° sealing feature will be discussed below.

Figure 6:
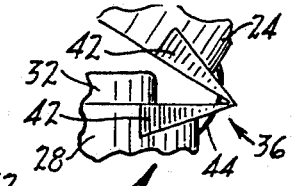
FIG. 6 is a fragmentary side elevation of the hinge portion of the closure cap construction of FIGS. 1–5, showing the relative positions of portions of the hinge when the sealing cap is in a partially closed position.
Figure 7:
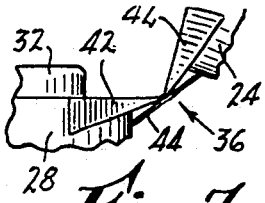
FIG. 7 is a fragmentary side elevation of the hinge portion of the closure cap construction of FIGS. 1–6, showing the relative positions of portions of the hinge when the sealing cap is in a mostly open, dispensing position. The hinge positions of FIGS. 6 and 7 are on opposite sides of the dead-center position of the hinge.

Also by the invention, a dead-center toggle function of the sealing cap hinge 36 is so arranged that it biases the sealing cap 18 to one of either of two oppositely-disposed positions in the absence of an external force applied to the sealing cap 18. The biasing toward these two positions is illustrated in FIGS. 6 and 7 respectively.

Figure 3:
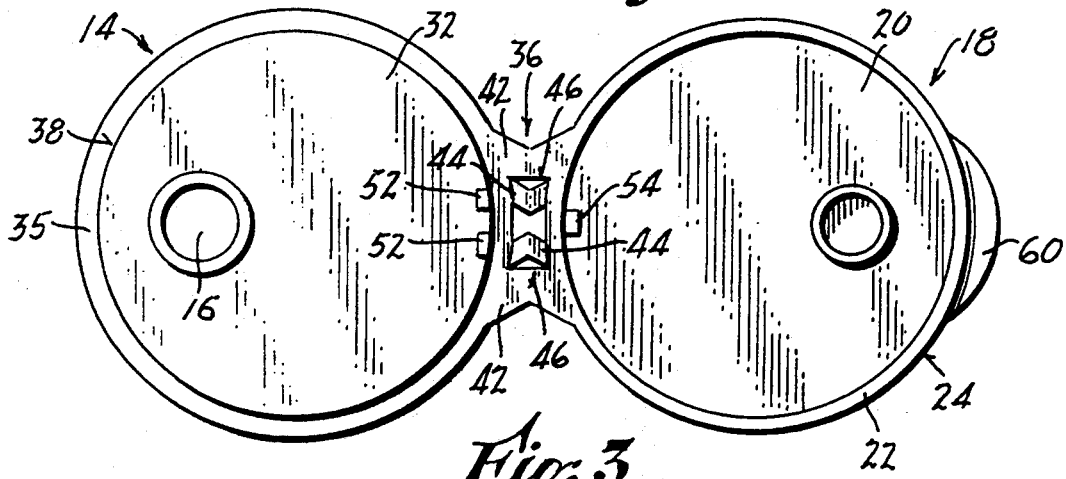
FIG. 3 is a top plan view of the closure cap construction of FIGS. 1 and 2.
Figure 4:
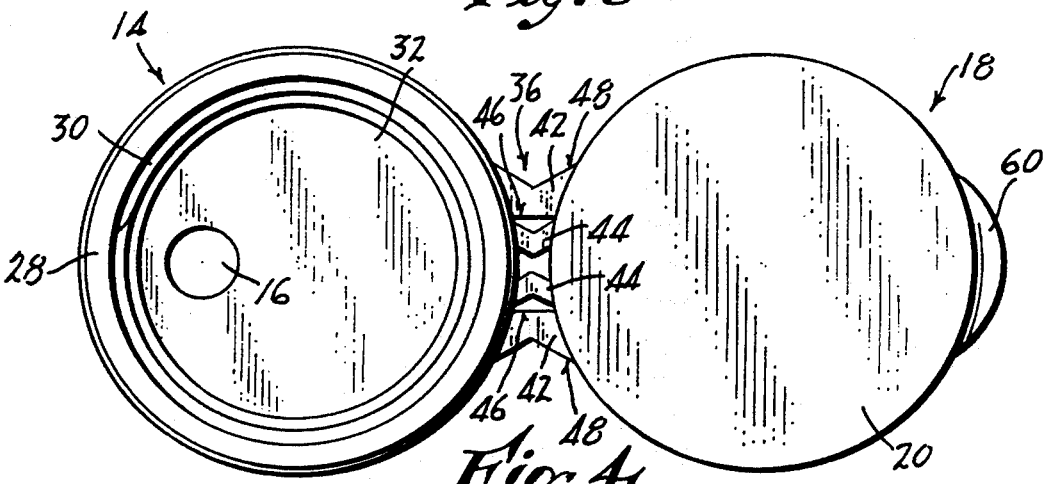
FIG. 4 is a bottom plan view of the closure cap construction of FIGS. 1–3.

In the preferred embodiment the hinge means is connected to closely adjoining portions of the wall 24 of the sealing cap and of the skirt 28 of the cap body. Specifically, there are provided two toggle joints each in the form of a web 42, and two tension members each in the form of a web 44, the latter being disposed between the toggle joint webs 42 as in FIGS. 3 and 5. The toggle joint webs 42 are formed integrally with both the cap body 14 and the sealing cap 18. Each toggle joint web 42 preferably has a rigid leg portion which is relatively incompressible, and has a tapered thickness as shown, together with a non-uniform width, FIG. 3. The inner longitudinal edges 46 of the two toggle joint webs 42 are substantially parallel to one another in the embodiment shown, with the two outer longitudinal edges 48 of the toggle joint webs 42 having a V-shaped profile, thus forming portions of convergent configuration. Preferably, the upper surfaces 50 of the toggle joint webs 42 lie in a common plane which is coplanar with that of the upwardly-facing shoulder 35 on the cap body 14. These upper surfaces 50 also are coplanar with the plane of the surface of the circular rim 24 of the sealing cap 18, FIG. 2.

Figure 5:
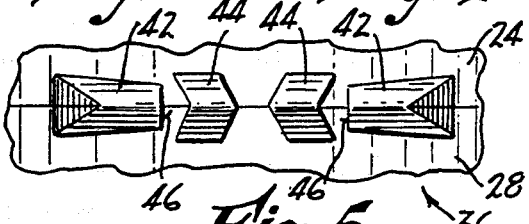
FIG. 5 is a fragmentary rear elevation of the closure cap construction of FIGS. 1–4, showing hinge details.

Referring again to FIGS. 3 and 5, the tension members 44 are coextensive with one another, and are shown as having a V-shaped, non-linear configuration when viewed from the top of the cap body with the sealing cap 18 in its opening position. The apices of the V-shaped tension members 44 face one another as shown. The points of attachment of the tension members 44 to the cap body 14 are below the points of attachment of the toggle joint webs 42 thereto, as seen in FIGS. 2, 5 and 6. Similarly, the points of attachment of the other ends of the tension members 44 to the sealing cap 18 are above the points of attachment of the toggle joint webs 42 thereto. The arrangement is such that the tension member webs 44 can resiliently expand or stretch by a limited amount (during which the webs straighten somewhat) as the sealing cap 18 is moved past dead-center, i.e. between its opening and closing positions. Moreover, the toggle joint webs 42 straddle the tension member webs 44 as the latter are being stretched.

As shown, the thickness of the tension members 44 is uniform and less than that of the toggle joint webs 42, which latter are tapered in both thickness and width.

The significance of the present inventive combination, namely the provision of a full circumferential seal between the cap body 14 and sealing cap 18, and a dead-center toggle hinge structure 36 is believed to constitute an important break-through in the closure field. Most prior constructions, including those of the patents of record above, did not incorporate a full peripheral seal as provided by applicant and set forth in the present specification. Instead, many of the prior devices employed either a complete or partial opening at the hinge area of the sealing cap, or a thin slit at the hinge area. In effect the periphery of the cap body top wall was generally unsealable due to the particular hinge web configuration required to effect the desired dead-center operation. With many of the prior caps, leakage of debris and/or water into the area on the upper surface of the cap body occurred during processing and shipping, resulting in the problems noted above in connection with the discussion under the BACKGROUND section of this specification.

Further in accordance with the invention there are provided, in combination with the hinge and seal structures described above, cooperable abutments on the sealing cap and cap body adjacent the hinge structure, which are engageable with one another when the sealing cap is disposed in its closing position, to thereby key the sealing cap to the cap body against turning, and thus avoid possible rupture of either the toggle joint webs or the tension member webs. In accomplishing this keying, there are provided on the plateau 32 of the cap body 14 a pair of upstanding solid nibs 52 which are located to receive a corresponding solid nib or projection 54 in the side wall 22 of the sealing cap 18 when the latter is disposed in its closing position. The nesting of the nib 54 between the nibs 52 prevents rotation of the sealing cap 18, especially that which might arise during assembly of the cap construction to the associated container and where automatic capping equipment is employed. As can be readily appreciated, other forms of abutment shoulders (such as notches or the like) could be employed to achieve the desired keying effect between the sealing cap 18 and the cap body 14.

Also in accordance with the invention, there is provided an improved closure detent which has been found, by demonstration on actual working models, to provide a moderate, desired retention of the sealing cap 18 in its closing position, while still enabling the sealing cap 18 to be readily opened by the consumer. In accomplishing this there are provided on the inside surface of the upstanding spout 34 an annular detent bead 56, and on the outer surface of the sealing plug 26, a cooperable annular detent bead 58. A finger-engageable lifting tab 60 is also included on the sealing cap 18. I term this arrangement a "soft touch" opening tab. During closing movement of the sealing cap 18, the detent beads 56, 58 forcibly by-pass one another by the pressure of the user's finger on the sealing cap 18. To open the cap construction, the consumer merely applies his finger to the underside of the lifting tab 60 and applies a small lifting force, which in turn causes by-pass of the detent beads 56, 58 and enables the sealing cap 18 to swing upwardly to the position of FIG. 6, for example, under the action of the "memory" of the webs.

From the above it can be seen that I have provided a novel and improved closure cap construction which is both simple in its structure, and reliable in use over extended periods of time. The unique combination provided by the peripheral seal and toggle-hinge are believed to be a significant break-through in the cap field, completely circumventing the problems noted previously in connection with undesirable entry of water and/or debris (mineral deposits) into the area between the plateau and the underside of the sealing cap.

The low profile of the cap construction, together with the small physical size of the finger-engageable lifting tab and of the hinges, results in a compact design which is resistant to damage from inadvertent bumping or jarring. Any tendency for breakage of the hinge is thus largely eliminated. The construction makes it possible to employ automatic capping equipment in the application of the caps, without special modifications to such equipment being required.

The disclosed construction is thus seen to constitute an important advance and improvement in the art.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A closure cap construction for a container, comprising in combination:

a) a cap body adapted to be mounted on the container, said cap body having a discharge opening, b) a sealing cap for the cap body, and c) snap-action hinge means connecting the sealing cap to the cap body for movement between an opening and closing position thereon, d) said cap body and sealing cap having cooperable engageable sealing means providing a complete peripheral seal therebetween when the sealing cap is disposed in its closing position on the cap body, e) said snap-action hinge means being disposed completely exteriorly of said sealing means so as to not impair the integrity of the latter, f) said hinge means comprising a pair of toggle joints extending between the sealing cap and cap body, and a pair of elongate, angularly-shaped stretchable tension webs disposed between said toggle joints and extending between the sealing cap and cap body.

2. A closure cap construction for a container, comprising in combination:

a) a cap body adapted to be mounted on the container, said cap body having a discharge opening, b) a sealing cap for the cap body, c) snap-action hinge means connecting the sealing cap to the cap body for movement between an opening and closing position thereon, and d) cooperable solid keying nibs on the cap body and sealing cap closely adjacent said hinge means, for preventing relative turning movement between the body and cap when the latter is in its closing position, to thereby avoid damage to said hinge means, e) said cap body and sealing cap having cooperable engageable sealing means providing a complete peripheral seal therebetween when the sealing cap is disposed in its closing position on the cap body, f) said snap-action hinge means being disposed completely exteriorly of said sealing means so as to not impair the integrity of the latter.

3. A closure cap construction for a container, comprising in combination:

a) a cap body adapted to be mounted on the container, said cap body having a discharge opening, b) a sealing cap for the cap body, and c) snap-action hinge means connecting the sealing cap to the cap body for movement between an opening and closing position thereon, d) said cap body and sealing cap having cooperable engageable sealing means providing a complete peripheral seal therebetween when the sealing cap is disposed in its closing position on the cap body, e) said snap-action hinge means being disposed completely exteriorly of said sealing means so as to not impair the integrity of the latter, f) said hinge means comprising a pair of toggle joints extending between the sealing cap and cap body, and a pair of tension members extending between the sealing cap and cap body, g) said tension members each having a generally V-shaped configuration and being coextensive with one another, the apices of the V-shapes pointing toward one another, said V-shapes permitting a limited resilient stretching of said tension members to occur as the sealing cap is moved between its opening and closing positions.

4. A closure cap construction for a container, comprising in combination:

a) a cap body adapted to be mounted on the container, said cap body having a discharge opening, b) a sealing cap for the cap body, and c) snap-action hinge means connecting the sealing cap to the cap body for movement between an opening and closing position thereon, d) said cap body and sealing cap having cooperable engageable sealing means providing a complete peripheral seal therebetween when the sealing cap is disposed in its closing position on the cap body, e) said snap-action hinge means being disposed completely exteriorly of said sealing means so as to not impair the integrity of the latter, f) cooperable keying means on the cap body and sealing cap, for preventing relative turning movement between the body and cap when the latter is in its closing position, to thereby avoid damage to said hinge means, g) said keying means comprising a pair of cooperable abutments on the sealing cap and cap body, said abutments engaging one another when the sealing cap is in its closing position and being disposed closely adjacent to said hinge means.

5. A closure cap construction for a container, comprising in combination:

a) a cap body adapted to be mounted on the container, said cap body having a discharge opening, b) a sealing cap for the cap body, and c) snap-action hinge means connecting the sealing cap to the cap body for movement between an opening and closing position thereon, d) said cap body and sealing cap having cooperable engageable sealing means providing a complete peripheral seal therebetween when the sealing cap is disposed in its closing position on the cap body, e) said snap-action hinge means being disposed completely exteriorly of said sealing means so as to not impair the integrity of the latter, f) cooperable keying means on the cap body and sealing cap, for preventing relative turning movement between the body and cap when the latter is in its closing position, to thereby avoid damage to said hinge means, g) said keying means comprising a pair of cooperable abutments on the sealing cap and cap body, said abutments engaging one another when the sealing cap is in its closing position, h) said abutments comprising a pair of upstanding nibs on the cap body, and a projection on the sealing cap, said sealing cap projection being received between said upstanding nibs on the cap body when the sealing cap is disposed in its closing position.

* * * * *